United States Patent [19]

O'Leary

[11] 4,158,905

[45] Jun. 26, 1979

[54] RETENTION CLAMP FOR TABLECLOTH

[76] Inventor: Gerard P. O'Leary, 93-25 215th St., Queens Village, N.Y. 11428

[21] Appl. No.: 807,887

[22] Filed: Jun. 20, 1977

[51] Int. Cl.[2] ..... A44B 21/00

[52] U.S. Cl. ..... 24/81 T; 24/81 C; 24/261 R

[58] Field of Search ..... 24/1, 11 R, 81 T, 81 C, 24/252 R, 255 R, 261 R; 248/316 D, 249, 226.5; 269/98

[56] References Cited

U.S. PATENT DOCUMENTS

| | | | |
|---|---|---|---|
| 411,188 | 9/1889 | Gira et al. | 24/261 R |
| 453,845 | 6/1891 | Murphy | 24/261 R |
| 643,952 | 2/1900 | Eastman | 24/1 |
| 705,496 | 7/1902 | Wales | 24/81 C |
| 1,049,803 | 1/1913 | Boyer | 24/81 C |
| 1,158,940 | 11/1915 | Litt et al. | 24/261 R |
| 1,310,587 | 7/1919 | Sumersille | 24/261 R |
| 1,621,720 | 3/1927 | Harper | 24/261 R |
| 2,375,374 | 5/1945 | Lepp | 24/261 R |

*Primary Examiner*—Henry Jaudon

[57] ABSTRACT

A clamp of bifurcated, double-looped construction, portions of which are adapted to slide over a cloth spread upon a picnic table and under the table top to resiliently secure the tablecloth to the top.

2 Claims, 4 Drawing Figures

RETENTION CLAMP FOR TABLECLOTH

BACKGROUND OF THE INVENTION

The present invention is concerned with solving simply and effectively a problem which is extremely bothersome to persons attempting to enjoy a picnic, whether it be in a park or backyard. If the air is at all breezy, picnic tablecloths are apt to blow away, or even if weighted by the placement of food or utensils thereon, are apt to flap about, sometimes are partially blown up and over the table top, and generally can become a nuisance which mars the enjoyment of the day.

The present invention provides a very simple, yet strong, corner clamp for resiliently securing a cloth to a picnic table merely by sliding the clamp into place. Prior attempts as illustrated by U.S. Pat. Nos. 1,049,803; 643,952; 3,727,272 and German Pat. No. 626,199 have not fully satisfied the need for an inobtrusive picnic cloth clamp, particularly one which is aesthetically pleasing, free of sharp edges and one which will accommodate a broad range of picnic table top thickness. The clamp of the present invention is, in addition to possessing the above characteristics, very inexpensive to manufacture, and because of its double-looped and all around shape is capable of exerting strong, steady clamping pressure which is distributed over a relatively wide area.

SUMMARY OF THE INVENTION

In accordance with the present invention, a table top clamp for securing a tablecloth to a picnic table and the like comprising a continuous unitary body having two lower parallel arms adapted to fit under a table top, sections connected to each of said arms curving in parallel vertical planes in a generally U-shaped configuration, said sections being adapted to curve about and fit over the edge of a table top; two upper arms generally parallel with each other and the lower arms are interconnected with the latter by the upwardly curving sections, and a horizontal curved section of generally U-shaped configuration connects the upper arms. The curvature of the upwardly curved section interconnecting the upper and lower arms is selected to accommodate a range of table top widths and to cause convergence of the parallel upper arms toward the parallel lower arms, such that when the clamp is slipped over and under a table top, the least table top width within the range will require spreading movement between the upper and lower arms.

DESCRIPTION OF A PARTICULAR EMBODIMENT

Figure 1:
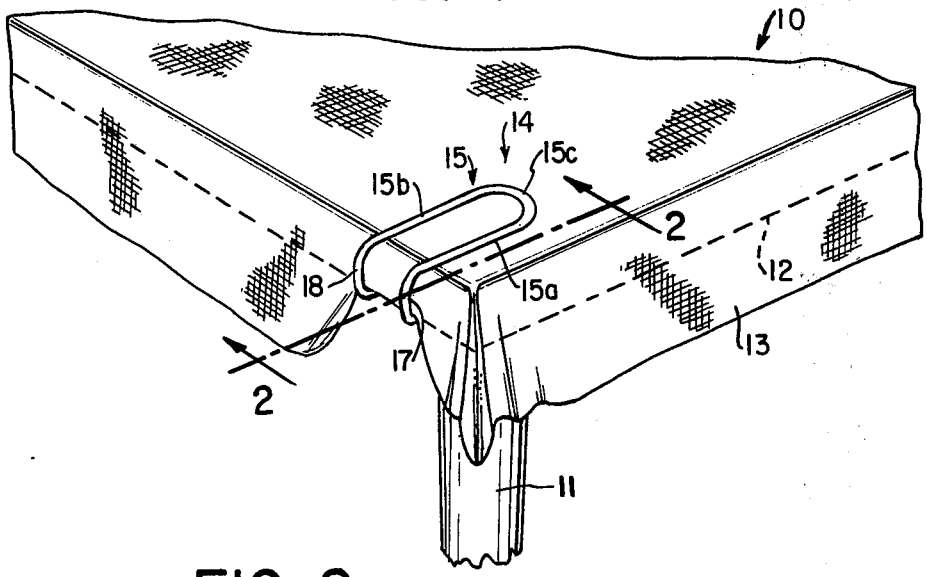
FIG. 1 is a partial, perspective view of a table with the clamp of the present invention securing one corner of a table cloth thereon.
Figure 2:
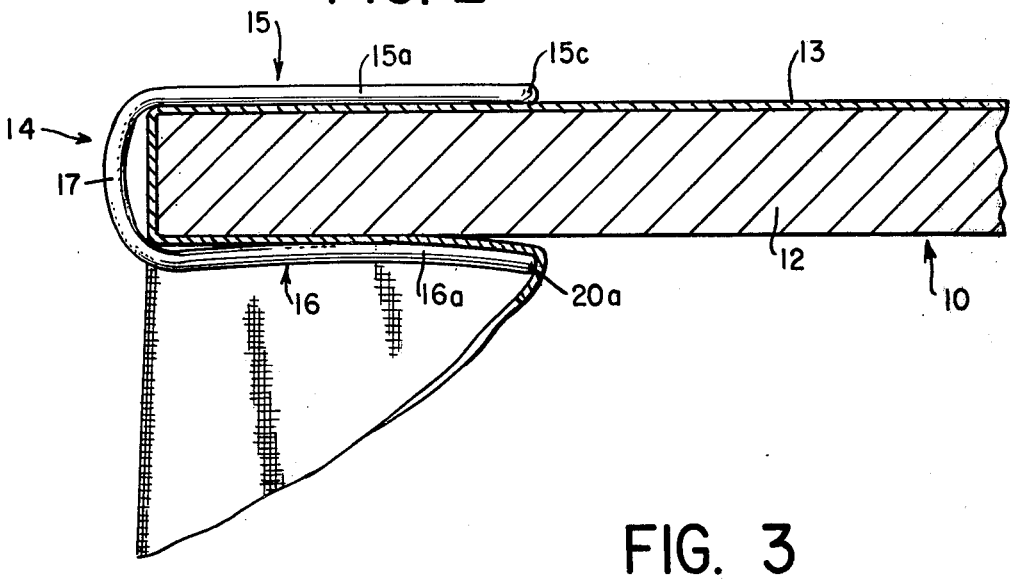
FIG. 2 is a cross section taken in the direction of Arrows 2—2 of FIG. 1.

Referring to the drawing and initially to FIGS. 1 and 2 thereof, a section of a table 10 (for example, a picnic table) has been illustrated. The table 10 has legs 11 and a top 12 with table cloth 13 spread thereupon. A novel clamp 14 constructed according to the present invention is shown positioned adjacent to one corner of the table so as to secure the tablecloth 13 in this area against displacement by the wind. It is contemplated that several clamps 14 will be used at spaced intervals about the top 12, the number depending upon the size of the table. In general, however, four clamps adjacent to each corner will suffice, particularly because of the clamps ability to resiliently secure the cloth 13 against the table top 12.

Figure 3:
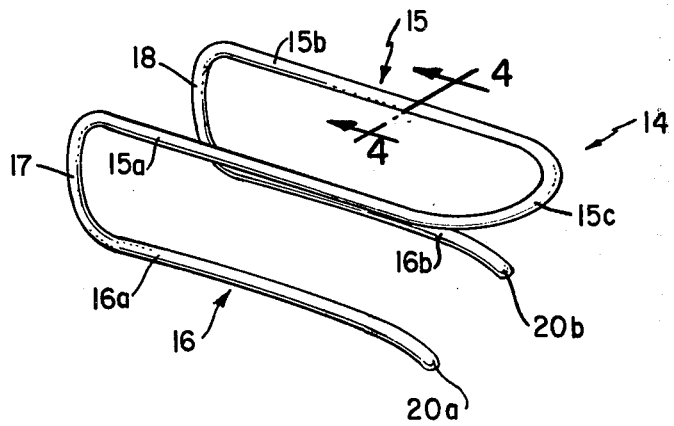
FIG. 3 is a perspective view of the clamp alone.
Figure 4:
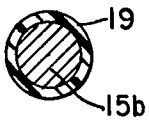
FIG. 4 is a cross section taken in the direction of Arrows 4—4 of FIG. 3.

Referring to FIGS. 3 and 4, it will be seen that the clamp 14 is bifurcated, having upper and lower sections 15 and 16 respectively. Upper section 15 consists of arms **15*a*, 15*b* which are joined by the rounded end member 15*c*. The lower section 16 consists of arms 16*a* and 16*b* which are joined respectively to the upper sections arms 15*a* and 15*b* by curved sections 17 and 18. The side sections 17 and 18** are constructed so as to accommodate a range of table top widths and to cause convergence of upper and lower arms to exert pressure on the least width top in the range.

Certain unique features of the clamp 14 can be seen from the illustrated form, particularly as shown in FIGS. 3 and 4. The clamp is actually a single, continuous tube, and in the particular embodiment, is constructed of metal covered with a layer of plastic 19 which protects the metal against chafing. Beginning with the tips **20*a* and 20*b* of the lower arms 16*a* and 16*b*, (which are bent slightly downward to permit arms 16*a* and 16*b* to slide easily under a table top), the lower arms 16*a* and 16*b* thereafter are relatively straight, then curve upwardly through sections 17 and 18 to loop back to form a vertically oriented U-shape and becoming upper arms 15*a* and 15*b*** which are part of a horizontally oriented U-shape. The terms "vertically" and "horizontally" have been used in the respect that these portions of the clamp will, when used, assume these directional relationships.

Thus, the clamp has a repetitive symmetry in two dimensions, which functionally provides great stability (the pressure is distributed widely) and strong, even clamping pressure when applied to a table top. The single integrated construction also makes it quite simple to manufacture.

It will be understood that the foregoing description has been of a particular embodiment and that variations therefrom are possible without departing from the inventive concept. For example, in an alternate form, the table top clamp might be molded entirely of a strong, resilient plastic material. Therefore, in order to appreciate fully the scope of the invention, reference shall be made to the appended claims.

I claim:

1. A table top clamp for securing a tablecloth to a picnic table and the like comprising a continuous, unitary body formed as a hollow tube capable of developing a spring-like clamping action, said unitary body having (a) two lower parallel arms adapted to fit under a table top;

(b) sections connected to each of said arms curving in parallel vertical planes in a generally U-shaped configuration, said sections being adapted to curve about and fit over the edge of a table top;

(c) two upper arms generally parallel with each other and said lower arms and interconnected with the latter by said upwardly curving sections; and (d) a horizontal curved section of generally U-shaped configuration connecting said upper arms, the curvature of the upwardly curved section interconnecting said upper and lower arms being selected to accommodate a range of table top widths and to cause convergence of said parallel upper arms toward said parallel lower arms, such that when the clamp is slipped over and under a table top, the least table top width within the range will require spreading movement between the upper and lower arms.

2. The table top clamp according to claim 1 wherein said tubular material is metal and a smooth, non-chafing material covers said tubular material.

* * * * *